US006966195B2

(12) United States Patent
Saeki

(10) Patent No.: US 6,966,195 B2
(45) Date of Patent: Nov. 22, 2005

(54) AIR CONDITIONING SYSTEM

(75) Inventor: Shinji Saeki, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 10/635,646

(22) Filed: Aug. 7, 2003

(65) Prior Publication Data

US 2004/0025524 A1 Feb. 12, 2004

(30) Foreign Application Priority Data

Aug. 9, 2002 (JP) ..... 2002-232584

(51) Int. Cl.[7] ..... F25B 49/00

(52) U.S. Cl. ..... 62/228.5; 417/222.2

(58) Field of Search ..... 62/228.5; 417/222.2, 417/213, 297, 298, 302

(56) References Cited

U.S. PATENT DOCUMENTS

| | | | | |
|---|---|---|---|---|
| 5,139,227 | A * | 8/1992 | Sumida et al. | 251/129.08 |
| 5,540,566 | A * | 7/1996 | Ishizaki et al. | 417/297 |
| 6,234,763 | B1 * | 5/2001 | Ota et al. | 417/222.2 |
| 6,332,329 | B1 * | 12/2001 | Takehana et al. | 62/227 |
| 6,334,759 | B1 * | 1/2002 | Kaneko et al. | 417/222.2 |
| 6,361,283 | B1 * | 3/2002 | Ota et al. | 417/222.2 |
| 6,439,858 | B1 * | 8/2002 | Kume et al. | 417/222.2 |
| 6,443,707 | B1 * | 9/2002 | Kimura et al. | 417/222.2 |
| 6,481,977 | B2 * | 11/2002 | Mameda et al. | 417/222.2 |
| 6,485,267 | B1 * | 11/2002 | Imai et al. | 417/222.2 |
| 6,572,341 | B2 * | 6/2003 | Kimura et al. | 417/213 |
| 6,604,912 | B2 * | 8/2003 | Umemura et al. | 417/222.2 |
| 6,682,314 | B2 * | 1/2004 | Umemura et al. | 417/222.2 |

FOREIGN PATENT DOCUMENTS

| | | | |
|---|---|---|---|
| EP | 0900936 A2 | * | 3/1999 |
| EP | 1 036 940 | | 9/2000 |
| EP | 1 091 125 | | 4/2001 |
| EP | 1 113 235 | | 7/2001 |
| JP | 402283982 A | * | 11/1990 |
| JP | 2001-132650 | | 5/2001 |

(Continued)

OTHER PUBLICATIONS

Patent Abstracts of Japan, Publication Number 2001-133053, dated May 18, 2001.

*Primary Examiner*—William E. Tapolcai
*Assistant Examiner*—Mohammad M. Ali
(74) *Attorney, Agent, or Firm*—Westerman, Hattori, Daniels & Adrian, LLP

(57) ABSTRACT

To provide an air conditioning system which simultaneously eliminates shortage of lubricating oil of a variable displacement compressor and degradation of cooling efficiency of the system. An air conditioning system is configured to have a variable displacement compressor under flow rate control by a proportional flow rate control solenoid valve forming a variable orifice in a discharge-side refrigerant flow passage, and a constant differential pressure valve for controlling a differential pressure (PdH−PdL) across the variable orifice, developed depending on a flow rate Qd of refrigerant, to a constant level, and an expansion valve of a normal charge type. By providing the expansion valve of the normal charge type, it is possible to always hold refrigerant at an outlet of an evaporator in a superheated state, whereby even during low load operation, high cooling efficiency can be maintained. Further, the proportional flow rate control solenoid valve can be controlled such that it causes refrigerant to flow at a minimum flow rate required for circulation of oil in response to an external signal. This makes it possible to prevent the variable displacement compressor from falling short of lubricating oil during the low load operation.

1 Claim, 7 Drawing Sheets

FOREIGN PATENT DOCUMENTS

| | | | |
|---|---|---|---|
| JP | 2001-133053 | | 5/2001 |
| JP | 2002168173 A | * | 6/2002 |
| WO | WO 02/057628 | | 7/2002 |

* cited by examiner

AIR CONDITIONING SYSTEM

CROSS-REFERENCE TO RELATED APPLICATIONS

This application is based upon and claims the benefits of priority from the prior Japanese Patent Application No.2002-232584, filed on Aug. 9, 2002, the entire contents of which are incorporated herein by reference.

BACKGROUND OF THE INVENTION (1) Filed of the Invention

This invention relates to an air conditioning system, and more particularly to an automotive air-conditioning system provided with a refrigeration cycle including a variable displacement compressor, a condenser, an expansion valve, and an evaporator.

(2) Description of the Related Art

Conventionally, in an automotive air-conditioning system, a variable displacement-type compressor is employed which is capable of controlling a suction pressure to a constant level depending on a cooling load.

As a variable displacement compressor, a swash plate type is known which has a swash plate disposed in a closed crank chamber and fitted on a rotating shaft receiving a driving force from an engine such that the inclination angle of the swash plate can be changed, and controls a pressure in the crank chamber to thereby change the inclination angle of the swash plate, whereby the amount of stroke of pistons connected to the swash plate is changed to change the displacement of discharged refrigerant. The pressure in the crank chamber is controlled by a capacity control valve. The capacity control valve controls a pressure introduced from a discharge chamber into the crank chamber in response to a suction pressure of the compressor. For example, when a cooling load decreases to make the suction pressure lower than a preset pressure, responsive to the lowered suction pressure, the capacity control valve increases a valve lift thereof, to thereby increase the flow rate of refrigerant introduced from the discharge chamber into the crank chamber. The increase in the differential pressure between the pressure in the crank chamber and the suction pressure cases the inclination angle of the swash plate to be reduced to decrease the stroke of the pistons, whereby the displacement of the compressor is decreased. As a result, the suction pressure is controlled to the preset pressure whereby the vent temperature of the evaporator can be held constant.

In the refrigeration cycle incorporating the above variable displacement compressor capable of controlling the suction pressure to a constant level, as an expansion valve therefor, a cross charge-type is employed. Referring to FIG. 5, in the cross charge, the pressure characteristic of refrigerant in the temperature-sensing chamber of an expansion valve is configured to have a gentler inclination than that of a saturated vapor curve of refrigerant used in the refrigeration cycle. The cross charge is attained by filling the temperature-sensing chamber of the expansion valve with a gas different from refrigerant used in the refrigeration cycle. By utilizing the cross charge, during low load operation in which refrigerant at an outlet of the evaporator has a low temperature, a pressure in the temperature-sensing chamber is higher than the saturated vapor curve, and hence the refrigerant at the outlet of the evaporator is placed in a state not completely evaporated, and returned to the compressor with liquid contained therein. The refrigerant includes lubricating oil for the compressor, so that when the variable displacement compressor is operating with a small capacity, the liquid returned is made use of to compensate for reduction of returned oil due to a decrease in the circulating amount of the refrigerant.

In the cross charge-type expansion valve, however, when the cooling load is low, liquid is returned to the variable displacement compressor, thereby degrading cooling efficiency, whereas during high load operation in which refrigerant at the outlet of the evaporator has a high temperature, the pressure in the temperature-sensing chamber is hard to be raised, and a superheat degree SH becomes too large, which makes it difficult to make the superheat properly balanced.

On the other hand, an air conditioning system is disclosed in Japanese Unexamined Patent Publication No. 2001-133053, which employs, as a variable displacement compressor, a compressor for controlling the flow rate of refrigerant discharged therefrom to a fixed flow rate set by an external signal, and an expansion valve of a normal charge type. According to this air conditioning system, since the variable displacement compressor is formed by a flow rate control-type compressor, it is possible to control the variable displacement compressor such that it causes refrigerant to flow at a flow rate required for circulation of oil during low load operation of the compressor, and since the expansion valve is formed by an expansion valve of the normal charge type, it is possible to hold refrigerant at the outlet of the evaporator in a state superheated to a predetermined superheat SH even during the low load operation, thereby making it possible to maintain a high cooling efficiency of the system.

SUMMARY OF THE INVENTION

An object of the present invention is to provide an air conditioning system which simultaneously solves a problem that a variable displacement compressor falls short of lubricating oil during low load operation, and a problem that cooling efficiency of the system is lowered during the low load operation, by a method other than the method disclosed in the above Japanese Unexamined Patent Publication No. 2001-133053.

To solve the above problem, the present invention provides an air conditioning system comprising a variable displacement compressor, a condenser, an expansion valve, and an evaporator, characterized in that the variable displacement compressor includes a proportional flow rate control solenoid valve responsive to an external signal for changing an area of a discharge-side or suction-side refrigerant flow passage, and a constant differential pressure valve for controlling a flow rate of refrigerant introduced from a discharge chamber into a crank chamber or refrigerant permitted to escape from the crank chamber to a suction chamber such that a differential pressure developed across the proportional flow rate control solenoid valve is constant, to thereby control refrigerant delivered to the condenser to a constant flow rate, and that the expansion valve is a normal charge-type expansion valve.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Hereinafter, embodiments of the present invention will be described in detail with reference to the drawings.

Figure 1:
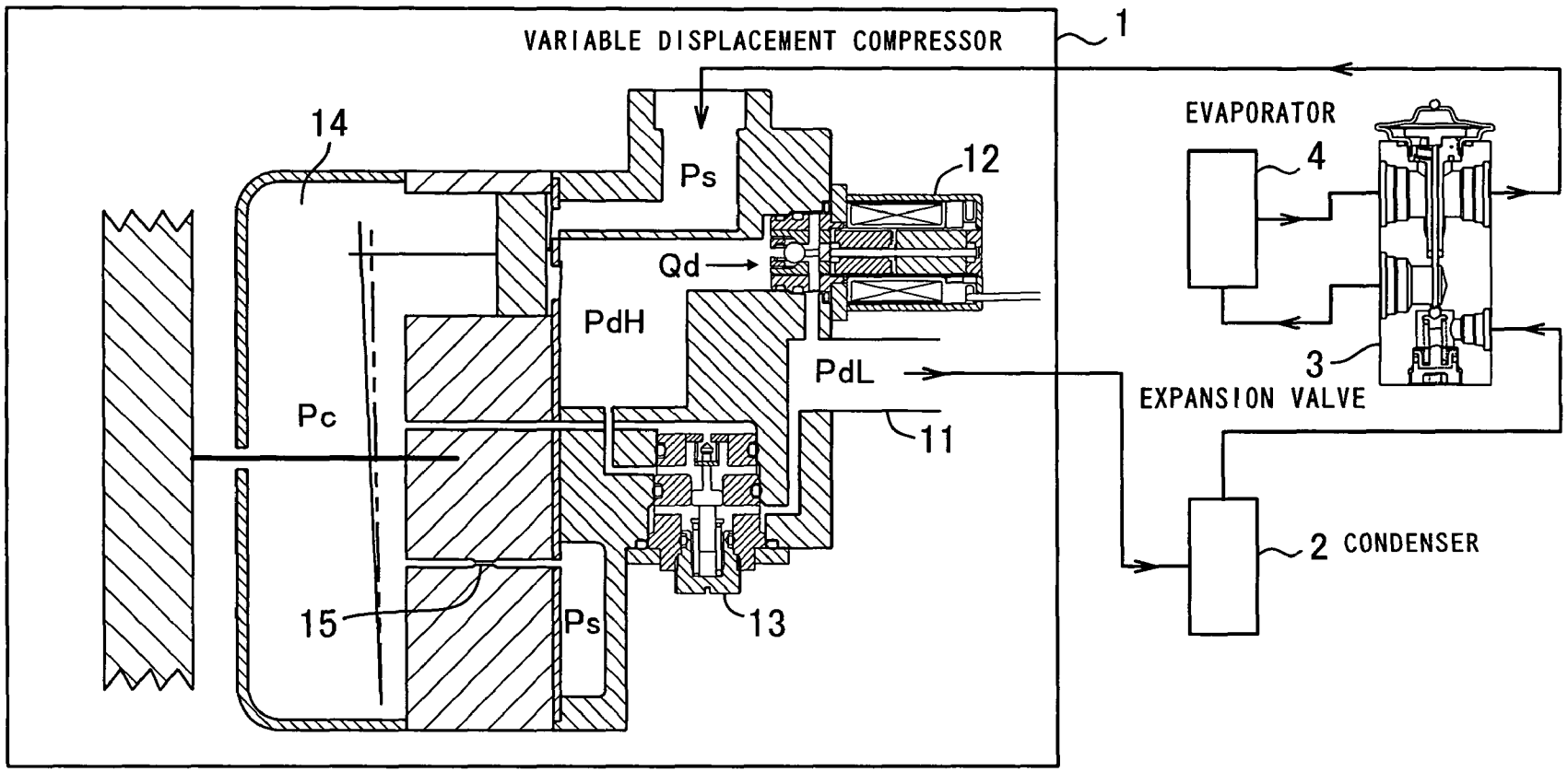
FIG. 1 is a diagram illustrating a first example of the construction of an air conditioning system according to the present invention.

FIG. 1 is a diagram illustrating a first example of the construction of an air conditioning system according to the present invention.

The air conditioning system comprises a variable displacement compressor 1 for compressing refrigerant, a condenser 2 for condensing the compressed refrigerant, an expansion valve 3 for adiabatically expanding the condensed refrigerant, and an evaporator 4 for evaporating the expanded refrigerant.

The variable displacement compressor 1 is of a flow rate control type that delivers refrigerant at a constant flow rate, while for the expansion valve 3, there is used a thermostatic type that has the same refrigerant as refrigerant used in a refrigeration cycle, filled in a temperature-sensing chamber thereof to form a normal charge type expansion valve.

The variable displacement compressor 1 has a proportional flow rate control solenoid valve 12 provided in an intermediate portion of a discharge-side refrigerant flow passage 11 leading from a discharge chamber thereof to the condenser 2. The proportional flow rate control solenoid valve 12 forms a variable orifice which is capable of proportionally changing the area of the discharge-side refrigerant flow passage 11 by an external signal. A discharge pressure from the discharge chamber on an upstream side of the proportional flow rate control solenoid valve 12 is designated by PdH, and a discharge pressure on a downstream side of the proportional flow rate control solenoid valve 12 is designated by PdL. Further, the discharge chamber is connected to a crank chamber 14 via a constant differential pressure valve 13, while the crank chamber 14 is connected to a suction chamber via a fixed orifice 15. The constant differential pressure valve 13 introduces therein the discharge pressure PdH from the discharge chamber, and the pressure PdL having passed through the proportional flow rate control solenoid valve 12 from the discharge-side refrigerant flow passage 11, and controls the flow rate of the refrigerant to be introduced from the discharge chamber to the crank chamber 14 such that a differential pressure (PdH−PdL) developed across the proportional flow rate control solenoid valve 12 is constant. In the variable displacement compressor 1, a pressure in the crank chamber 14 is designated by Pc, and a suction pressure is designated by Ps.

Next, description will be given of examples of the proportional flow rate control solenoid valve 12 and the constant differential pressure valve 13, which are employed in the variable displacement compressor 1.

Figure 2:
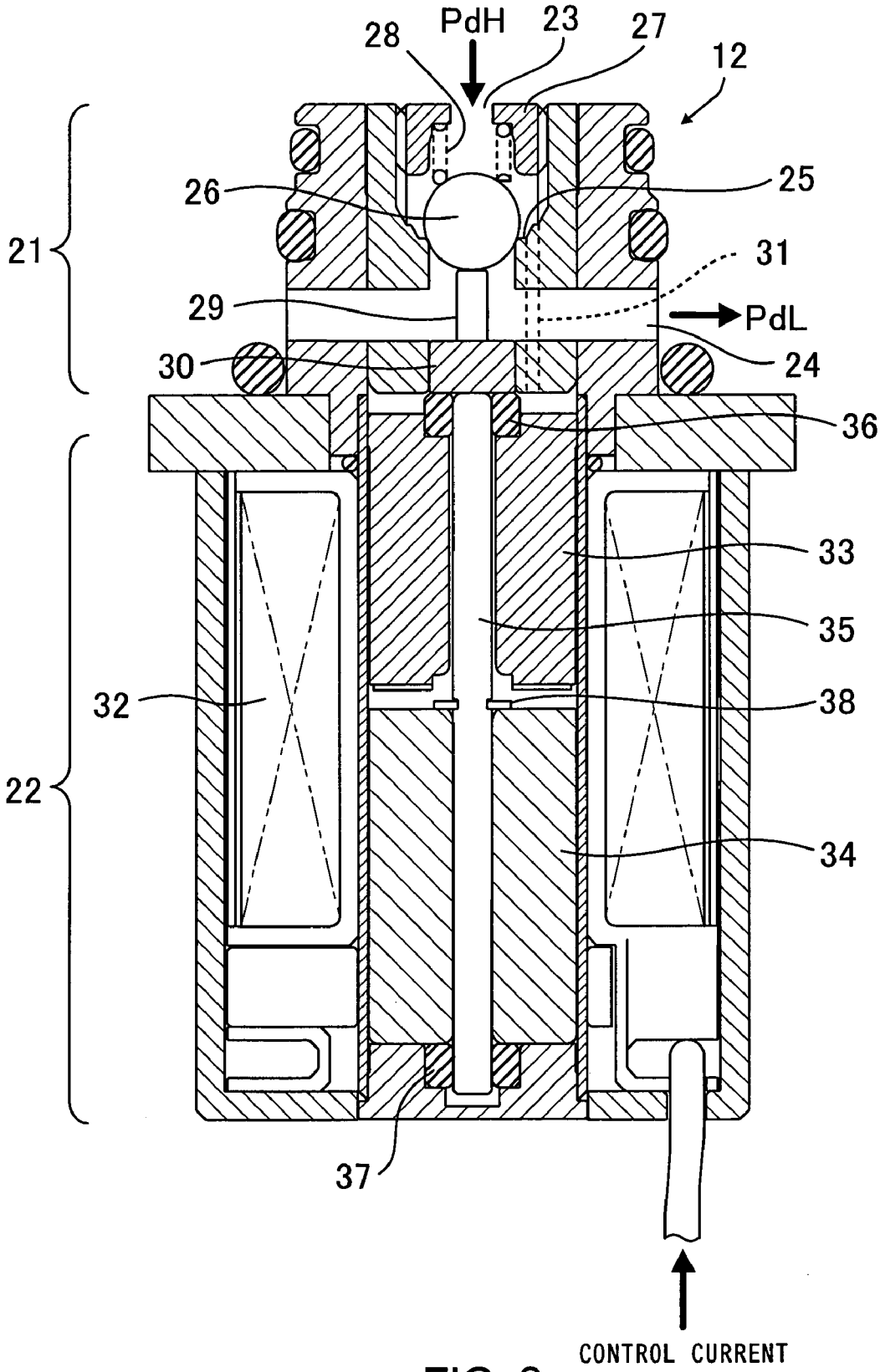
FIG. 2 is a cross-sectional view showing details of a proportional flow rate control solenoid valve.
Figure 3:
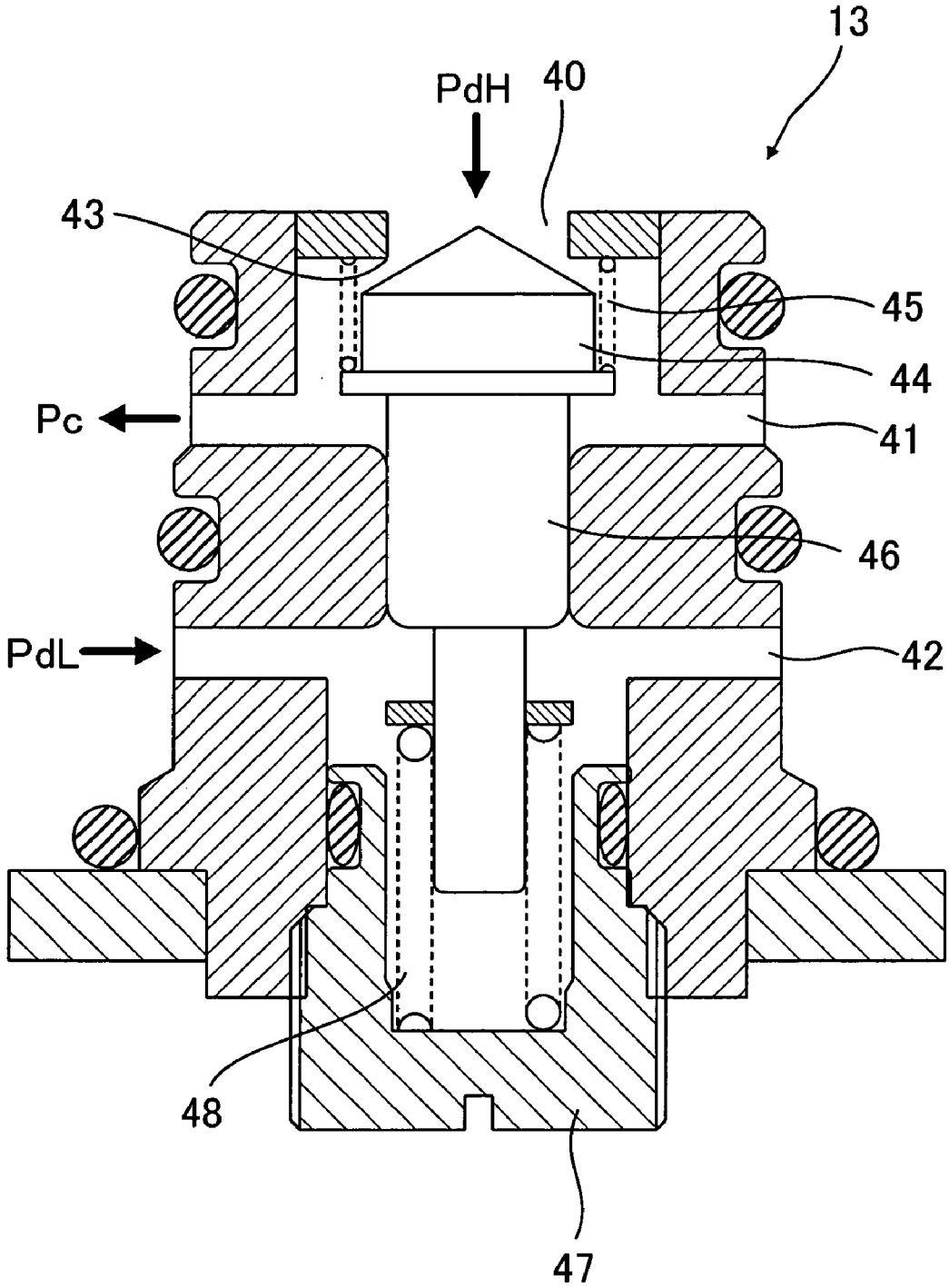
FIG. 3 is cross-sectional view showing details of a constant differential pressure valve.

FIG. 2 is a cross-sectional view showing details of the proportional flow rate control solenoid valve, and FIG. 3 is a cross-sectional view showing details of the constant differential pressure valve.

Referring to FIG. 2, the proportional flow rate control solenoid valve 12 comprises a valve section 21 and a solenoid section 22. The valve section 21 includes a port 23 for introducing the discharge pressure PdH from the discharge chamber, and a port 24 for guiding out the pressure PdL reduced by the valve section 21 into the discharge-side refrigerant flow passage 11. A passage communicating between these ports is formed with a valve seat 25, and on the upstream side of the valve seat 25 is disposed a ball-shaped valve element 26 in a manner opposed to the valve seat 25. An adjusting screw 27 is screwed into an open end of the port 23, and a spring 28 is arranged between the valve element 26 and the adjusting screw 27, for urging the valve element 26 in the valve-closing direction. Further, the valve element 26 is in abutment with one end of a shaft 29 axially extending through a valve hole. The other end of the shaft 29 is rigidly fixed to a piston 30 arranged in an axially movable manner. The piston 30 has substantially the same diameter as that of the valve hole such that the pressure PdL on the downstream side of the valve element 26 is equally applied in respective opposite axial directions to prevent the pressure PdL from adversely affecting the control of the valve element 26. Further, a communication passage 31 is formed between a space on the upstream side of the valve element 26 and a space on a solenoid section side of the piston 30 such that the discharge pressure PdH is introduced on a back pressure side of the piston 30 to thereby cancel out the discharge pressure PdH applied to the valve element 26.

The solenoid section 22 includes a solenoid coil 32, a core 33, a plunger 34, and a shaft 35. The shaft 35 has both ends supported by guides 36, 37, respectively. The shaft 35 has an E ring 38 fitted on an approximately central portion thereof such that the shaft 35 is moved together with the plunger 34 when the plunger 34 is attracted by the core 33. Due to this configuration, when the plunger 34 is moved upward, as viewed in the figure, the shaft 35 pushes the piston 30 abutting an upper end thereof, as viewed in the figure, which acts on the valve element 26 in the valve-opening direction. The amount of movement of the shaft 35 is proportional to the value of an electric current supplied to the solenoid coil 32. Therefore, the area of a flow passage of refrigerant passing through the proportional flow rate control solenoid valve 12 can be determined depending on the value of a control current supplied to the solenoid coil 32.

As shown in FIG. 3, the constant differential pressure valve 13 includes a port 40 for introducing therein the discharge pressure PdH from the discharge chamber, a port 41 for introducing the pressure Pc controlled by the constant differential pressure valve 13 into the crank chamber 14, and a port 42 for introducing therein the pressure PdL reduced by the proportional flow rate control solenoid valve 12.

A passage communicating between the port 40 and the port 41 is formed with a valve seat 43, and on the downstream side of the valve seat 43 is arranged a valve element 44 in a manner opposed to the valve seat 43. The valve element 44 is formed with a flange, and a spring 45 is disposed between the valve seat 43 and the flange, for urging the valve element 44 in the valve-opening direction.

On the same axis as that of the valve element 44, there is provided a pressure-sensing piston 46 which is axially movably arranged for receiving the pressure Pc from the crank chamber 14, in the port 41 and the pressure PdL from the port 42 at respective both end faces thereof. The pressure-sensing piston 46 is rigidly fixed to the valve element 44 for motion in unison therewith.

On a lower side of the pressure-sensing piston 46, as viewed in the figure, a spring load-adjusting screw 47 is provided. Arranged between the pressure-sensing piston 46 and the load-adjusting screw 47 is a spring 48 for urging the pressure-sensing piston 46 in the direction of closing of the valve element 44.

In the variable displacement compressor constructed as above, the proportional flow rate control solenoid valve 12 is supplied with a predetermined control current for narrowing the discharge-side refrigerant flow passage 11 communicating with the condenser to thereby form an orifice of a predetermined size such that a predetermined differential pressure (PdH−PdL) is developed depending on the flow rate Qd of refrigerant flowing through the discharge-side refrigerant flow passage 11. Further, in the constant differential pressure valve 13, the pressure-sensing piston 46 receives the predetermined differential pressure (PdH>PdL), and the valve element 44 is made stationary in a position where a force directed downward, as viewed in the figure, caused by the predetermined differential pressure, and the loads of the springs 45, 48 are balanced, to thereby control the valve lift of the constant differential pressure valve 13. Therefore, the constant differential pressure valve 13 senses the differential pressure across the proportional flow rate control solenoid valve 12, determined by the control current, and adjusts the valve lift thereof such that the differential pressure becomes equal to a predetermined value (i.e. the fixed flow rate Qd) set in advance, thereby controlling the flow rate of refrigerant introduced into the crank chamber 14. Thus, a constant flow rate-type variable displacement compressor is constructed.

Next, a description will be given of an example of the normal charge-type expansion valve 3 combined with the constant flow rate-type variable displacement compressor.

Figure 4:
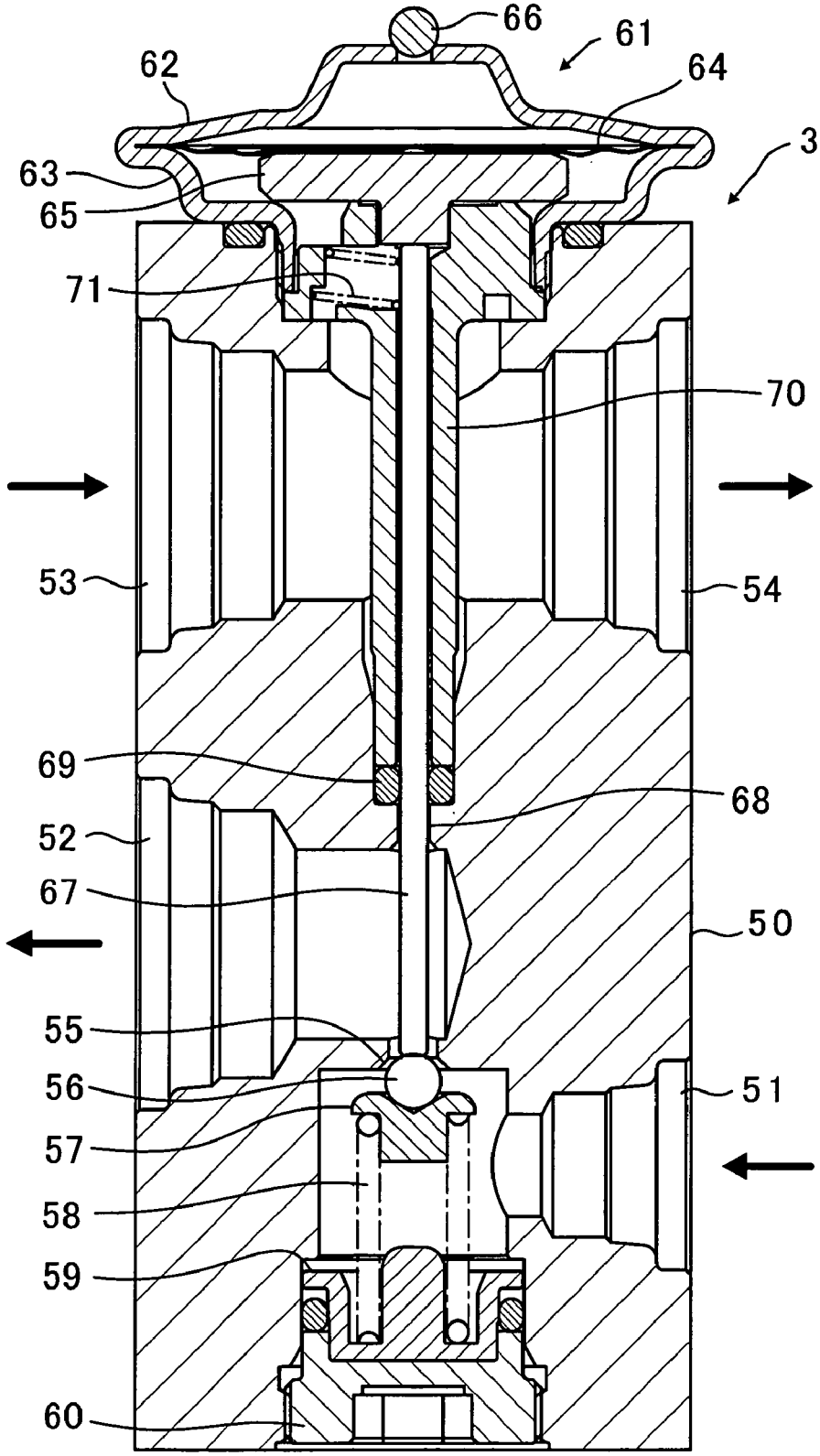
FIG. 4 is longitudinal cross-sectional view showing an example of the construction of an expansion valve.
Figure 5:
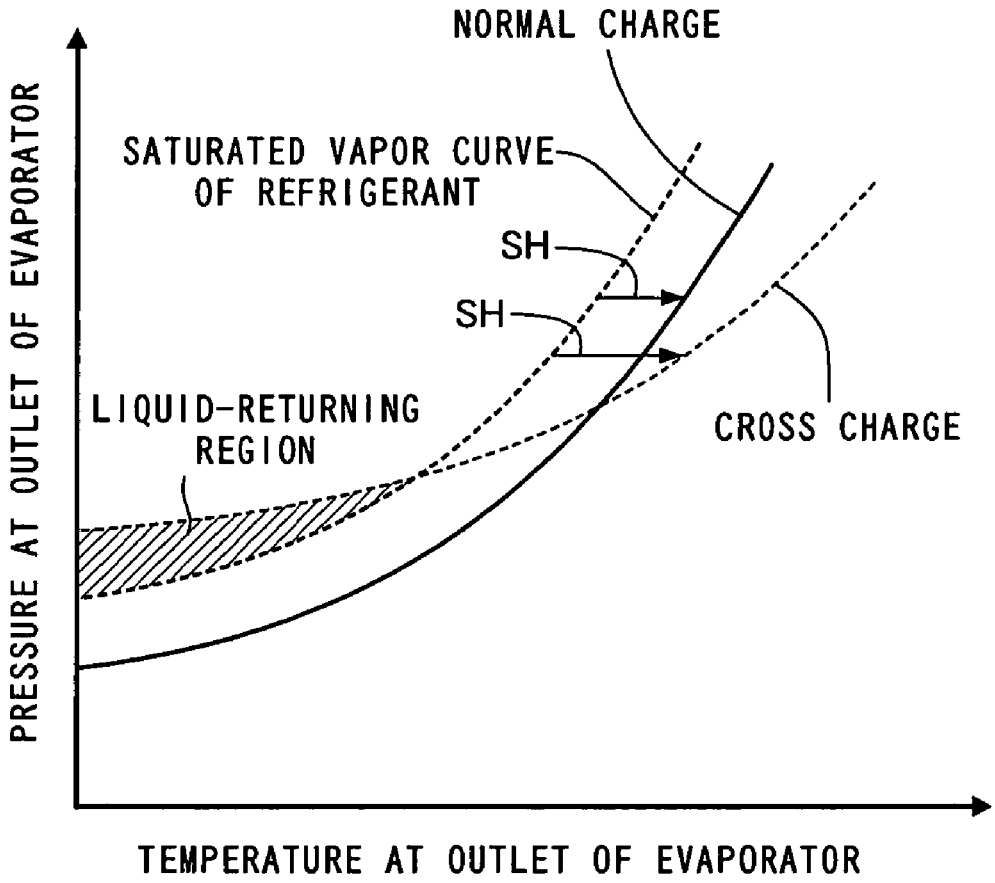
FIG. 5 is diagram useful in explaining characteristics of the expansion valve.

FIG. 4 is a longitudinal cross-sectional view showing an example of the construction of the expansion valve, and FIG. 5 is a diagram useful in explaining the characteristics of the expansion valve.

The expansion valve 3 includes a body block 50 having side portions formed with a port 51 for introducing refrigerant, a port 52 for delivering refrigerant, and ports 53, 54 for being inserted into piping leading from an evaporator to a compressor.

In a fluid passage between the port 51 and the port 52, a valve seat 55 is integrally formed with the body block 50, a ball-shaped valve element 56 is disposed in a manner opposed to the valve seat 55 from the upstream side, and refrigerant undergoes adiabatic expansion when it flows through a gap between the valve seat 55 and the valve element 56. Further, the valve element 56 is urged by a compression coil spring 58 via a valve element receiver 57 for receiving the valve element 56 in a direction of being seated on the valve seat 55. The compression coil spring 58 is received by a spring receiver 59 and an adjusting screw 60.

A power element 61 is provided at an upper end of the body block 50. The power element 61 comprises an upper housing 62, a lower housing 63, a diaphragm 64, and a center disk 65. A temperature-sensing chamber enclosed by the upper housing 62 and the diaphragm 64 is filled with the same refrigerant as refrigerant used in the refrigeration cycle, and sealed by a metal ball 66.

The upper end of a shaft 67 is in abutment with the center disk 65. The shaft 67 is inserted through a through hole 68 formed in the body block 50, and has a lower end thereof in abutment with the valve element 56.

The through hole 68 has an upper part thereof expanded, and an O ring 69 is disposed at a stepped portion thereof, for sealing a gap between the shaft 67 and the through hole 68.

Further, the upper end of the shaft 67 is held by a holder 70 which has a hollow cylindrical portion extending downward across a fluid passage communicating between the ports 53, 54. The lower end of the holder 70 is fitted in the expanded portion of the through hole 68 and retains the O ring 69.

A coil spring 71 is disposed at an upper portion of the holder 70, for suppressing axial vibrations of the shaft 67.

In the expansion valve 3 constructed as above, before the air conditioning system is activated, the pressure of refrigerant in piping leading from the evaporator 4 to the suction chamber of the variable displacement compressor 1 is high, and hence the diaphragm 64 of the power element 61, having sensed the high pressure of the refrigerant, is displaced upward, as viewed in the figure, and the valve element 56 is urged by the compression coil spring 58 and seated on the valve seat 55, whereby the expansion valve 3 is placed in a fully-closed state.

When the air conditioning system is activated, the pressure of refrigerant at an outlet of the evaporator 4 is rapidly reduced. The diaphragm 64 detects the reduction of the pressure of the refrigerant, and immediately displaces itself downward, as viewed in the figure, to thereby bring the center disk 65 into abutment with a top surface of the holder 70, as shown in the figure. This causes the shaft 67 to move downward to its lowest position, whereby the expansion valve 3 is fully opened. Therefore, immediately after the activation of the air conditioning system, the expansion valve 3 is fully opened to supply refrigerant to the evaporator 4 at a maximum flow rate.

As the temperature of the refrigerant returned from the evaporator 4 is lowered, the temperature in a temperature-sensing chamber of the power element 61 is lowered, whereby the refrigerant in the temperature-sensing chamber is condensed on the inner surface of the diaphragm 64. This causes pressure in the temperature-sensing chamber to be reduced to displace the diaphragm 64 upward, so that the shaft 67 is pushed by the compression coil spring 58, to move upward. As a result, the valve element 56 is moved toward the valve seat 55, whereby the passage area of the high-pressure refrigerant is reduced to decrease the flow rate of refrigerant sent into the evaporator 4. Thus, the valve lift of the expansion valve 3 is set to a value corresponding to a flow rate dependent on the cooling load. At this time, since the expansion valve 3 is of the normal charge type, it can always hold refrigerant at an outlet of the evaporator 4 in a state superheated to a predetermined superheat SH, as shown in FIG. 5. That the refrigerant at the outlet of the evaporator 4 has no wetness and is always in a superheated state means. This means that the variable displacement compressor 1 is no longer required to perform extra operation of evaporating wet refrigerant during suction of the refrigerant therein and is therefore made free from useless operation, thereby having an enhanced coefficient of performance. Therefore, the variable displacement compressor 1 becomes capable of maintaining high cooling efficiency from time of high load operation during which refrigerant at the outlet of the evaporator 4 has a high temperature to time of low load operation during which refrigerant at the outlet of the evaporator 4 has a low temperature. Further, during the low load operation, the proportional flow rate control solenoid valve 12 can be controlled such that it causes refrigerant to flow at a minimum flow rate required for circulation of oil, so that it is possible to prevent seizure of the variable displacement compressor 1, due to oil shortage.

Figure 6:
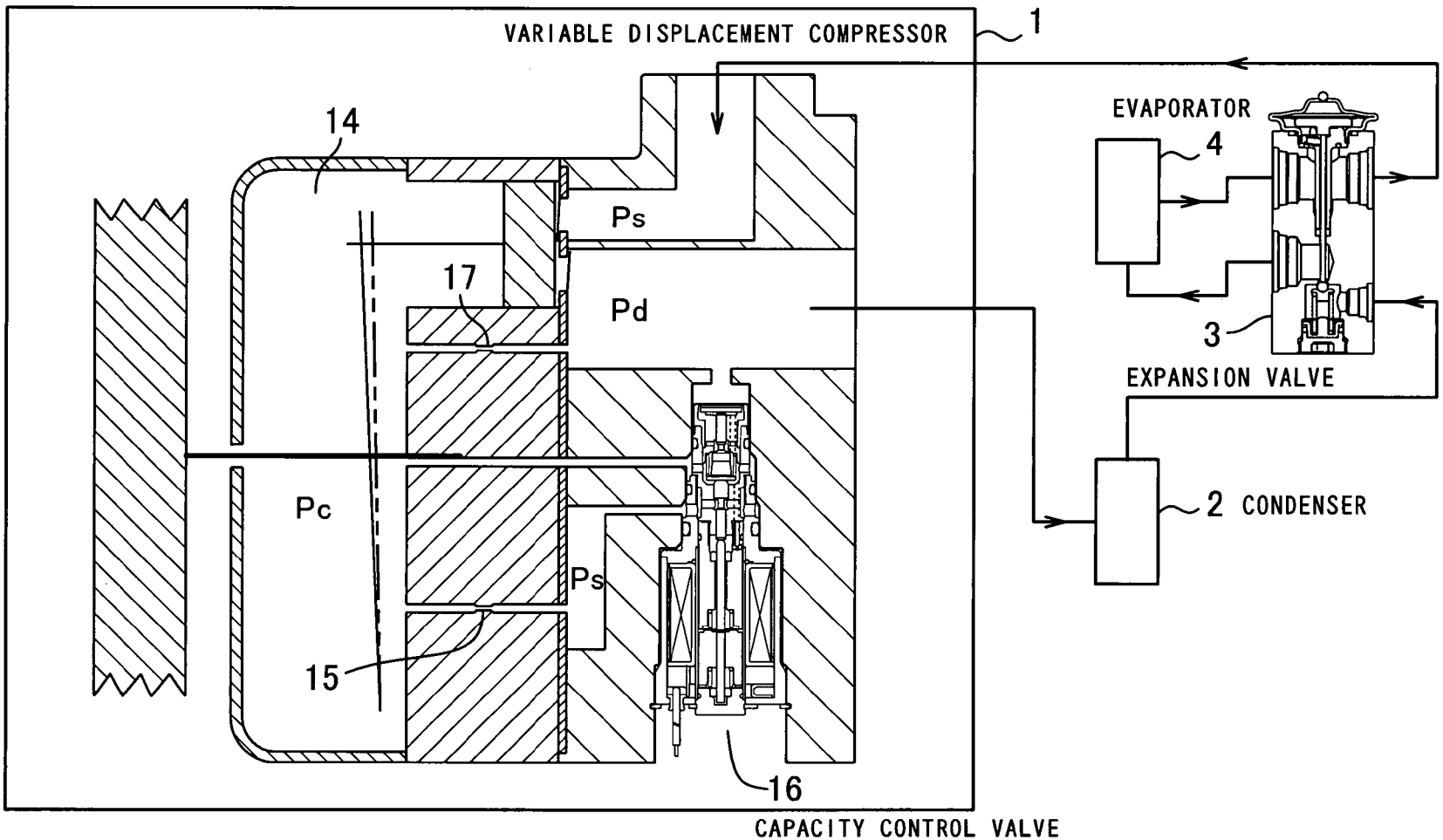
FIG. 6 is diagram illustrating a second example of the construction of the air conditioning system according to the present invention.
Figure 7:
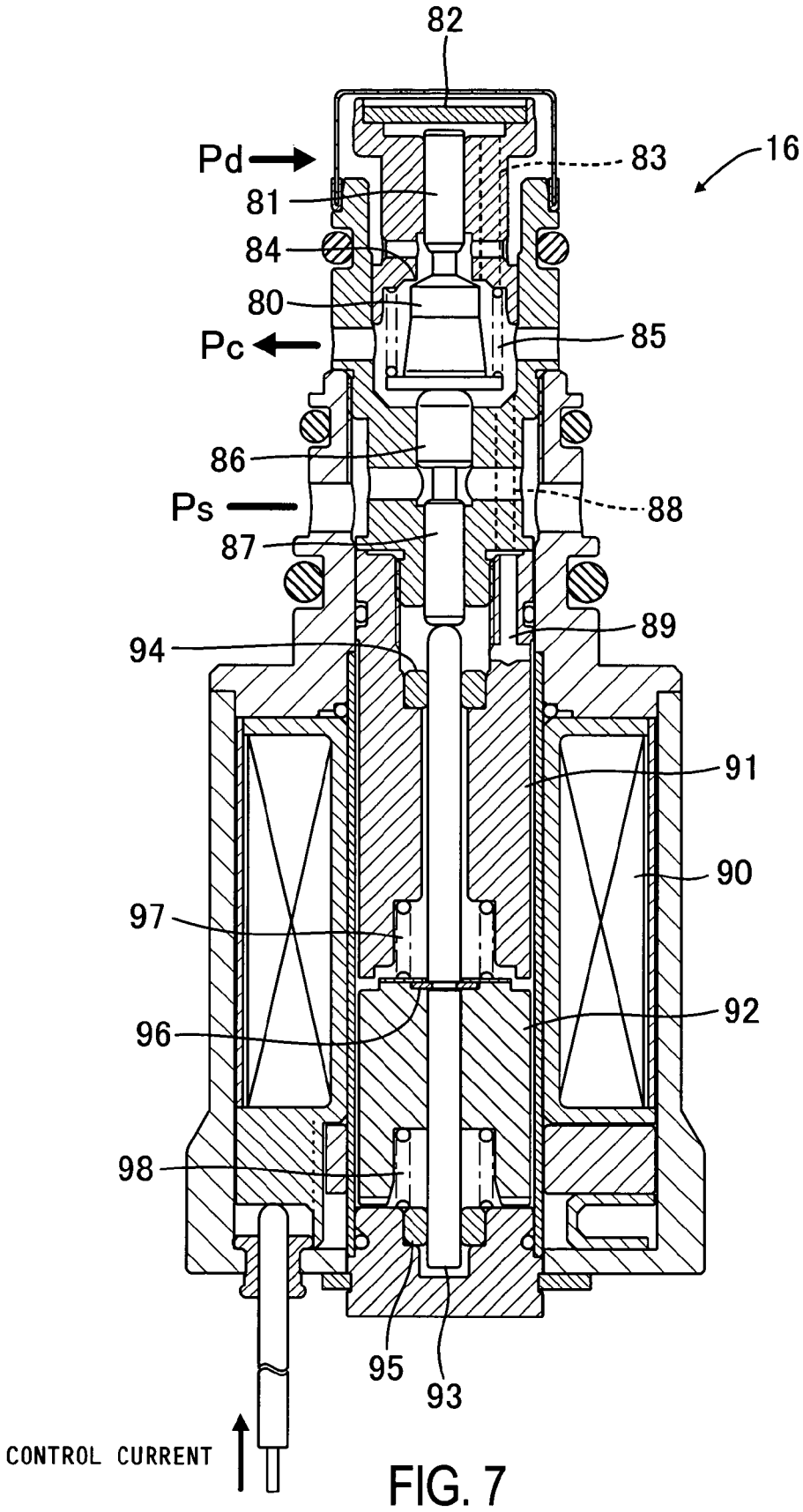
FIG. 7 is Cross-sectional view showing details of a capacity control valve employed in a variable displacement compressor.

FIG. 6 is a diagram illustrating a second example of the construction of the air conditioning system according to the present invention, and FIG. 7 is a cross-sectional view showing details of a capacity control valve employed in the variable displacement compressor. It should be noted that in FIG. 6, component elements identical to or equivalent to those shown in FIG. 1 are designated by identical reference numerals, and detailed description thereof is omitted.

The air conditioning system includes a variable displacement compressor 1 of a differential pressure control-type which controls a differential pressure Δ P between a discharge pressure Pd and a suction pressure Ps to a constant level, and as the expansion valve 3, there is employed one shown in FIG. 4, which has the same refrigerant as refrigerant used in the refrigeration cycle, filled in a temperature-sensing chamber to form a normal charge type expansion valve.

The variable displacement compressor 1 has a capacity control valve 16 provided at an intermediate portion of a refrigerant passage leading from a discharge chamber to a crank chamber 14, for control of the differential pressure Pd−Ps, and orifices 17, 15 provided between the discharge chamber and the crank chamber 14, and between the crank chamber 14 and a suction chamber, respectively.

As shown in FIG. 7, the capacity control valve 16 has a valve element 80 for receiving the discharge pressure Pd from the discharge chamber and introducing a pressure Pc into the crank chamber 14. The valve element 80 is integrally formed with a pressure-sensing piston 81. The pressure-sensing piston 81 is configured such that an upper end thereof, as viewed in the figure, has a space sealed by a plate 82 to receive the pressure Pc toward the crank chamber 14 via a passage 83. The valve element 80 is urged by a spring 85 in a direction in which it moves away from a valve seat 84.

Two piston rods 86, 87 having different diameters are axially movably arranged between the valve element 80 and a solenoid section. The upper piston rod 86 has the same diameter as the inner diameter of the valve seat 84, and the lower piston rod 87 has the same diameter as that of the pressure-sensing piston 81 integrally formed with the valve element 80. A connecting section for connecting the piston rods 86, 87 to each other is reduced in diameter to form a space for communicating with the suction chamber to receive the suction pressure Ps. A lower end, as viewed in the figure, of the piston rod 87 is configured to receive the pressure Pc toward the crank chamber 14 via passages 88, 89.

The solenoid section includes a solenoid coil 90, a core 91, a plunger 92, and a shaft 93. The shaft 93 has both ends thereof supported by guides 94, 95, and an upper end portion thereof is in abutment with the piston rod 87. The shaft 93 has an E ring 96 fitted thereon such that when the plunger 92 is moved in a manner attracted by the core 91, the shaft 93 is moved together with the plunger 92. Further, springs 97, 98 are disposed at axially both ends of the plunger 92.

The capacity control valve 16 forms a differential pressure valve that senses the differential pressure Δ P between the discharge pressure Pd and the suction pressure Ps, for operation, and controls the flow rate of refrigerant flowing from the discharge chamber to the crank chamber 14 such that the differential pressure Δ P becomes constant. The differential pressure Δ P to be controlled to be constant can be set by a control current, which is an external signal, supplied to the solenoid coil 90 of the solenoid.

In the variable displacement compressor 1 constructed as above, during the low load operation, the capacity control valve 16 is capable of controlling the differential pressure Pd−Ps to a constant level such that refrigerant is caused to flow at the minimum flow rate required for circulation of oil, and hence it is possible to prevent seizure of the variable displacement compressor 1, due to oil shortage. Further, since the expansion valve 3 of the normal charge type is used, it is possible to always hold refrigerant at an outlet of an evaporator in a state superheated to a predetermined superheat SH, even during the low load operation. This makes it possible to maintain high cooling efficiency of the air conditioning system.

Although in the above example, the case has been described where the differential pressure control-type variable displacement compressor 1 controls refrigerant supplied from the discharge chamber to the crank chamber 14 such that the differential pressure Pd−Ps is constant, this is not limitative, but as disclosed in FIGS. 1 to 4 in Japanese Unexamined Patent Publication No. 2001-132650, there may be employed a Pd−Ps differential pressure constant control-type variable displacement compressor which is configured to control refrigerant permitted to escape from the crank chamber 14 to the suction chamber such that the differential pressure Pd−Ps is constant, and further a Pd−Pc differential pressure constant control-type variable displacement compressor which is configured to control refrigerant introduced from the discharge chamber into the crank chamber 14 or refrigerant permitted to escape from the crank chamber 14 to the suction chamber such that the differential pressure between the discharge pressure Pd and the pressure Pc in the crank chamber 14 is constant.

Although in the example illustrated in FIG. 1, the flow rate of refrigerant passing through the variable displacement compressor is detected on the discharge side, a variable orifice may be disposed on the suction-side refrigerant flow passage to thereby detect the flow rate of refrigerant passing through the variable displacement compressor on the suction side of the compressor. Further, although the variable displacement compressor is configured such that the constant differential pressure valve 13 for controlling the pressure in the crank chamber 14 is provided in the passage communicating between the discharge chamber and the crank chamber 14 to thereby control the flow rate of refrigerant introduced from the discharge chamber into the crank chamber 14, while the fixed orifice 15 is provided in the passage communicating between the crank chamber 14 and the suction chamber, this is not limitative, but the variable displacement compressor may be configured such that an orifice is provided in the passage communicating between the discharge chamber and the crank chamber 14, and the constant differential pressure valve 13 is provided in the passage communicating between the crank chamber 14 and the suction chamber, to thereby control the flow rate of refrigerant on the side where the refrigerant is permitted to escape from the crank chamber 14 to the suction chamber.

Further, although in the example illustrated in FIG. 1, the proportional flow rate control solenoid valve 12 serving as a variable orifice is configured to proportionally change the area of the discharge-side refrigerant flow passage in response to an external signal, a proportional flow rate control solenoid valve may be employed which is capable of changing the area e.g. in the form of a quadratic curve.

As described heretofore, according to the present invention, the air conditioning system is configured to have a variable displacement compressor under flow rate control by a proportional flow rate control solenoid valve forming a variable orifice in a discharge-side refrigerant flow passage, and a constant differential pressure valve for controlling a differential pressure across the variable orifice to a constant level, and an expansion valve of a normal charge type. Alternatively, the air conditioning system is configured to have a variable displacement compressor under differential pressure control by a capacity control valve, and an expansion valve of a normal charge type. This makes it possible to always hold refrigerant at an outlet of an evaporator in a superheated state, whereby even during low load operation, it is possible to maintain high cooling efficiency of the system. Further, the proportional flow rate control solenoid valve employed in the variable displacement compressor of the flow rate control type, or the capacity control valve employed in the variable displacement compressor of the differential pressure control type can be controlled such that it causes refrigerant to flow at a minimum flow rate required for circulation of oil in response to an external signal. This makes it possible to prevent the variable displacement compressor from falling short of lubricating oil during the low load operation.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An air conditioning system comprising a variable displacement compressor, a condenser, a normal charge-type expansion valve, and an evaporator, characterized in that said variable displacement compressor includes a proportional flow rate control solenoid valve responsive to an external signal for changing an area of a discharge-side or suction-side refrigerant flow passage, and a constant differential pressure valve for controlling a flow rate of refrigerant introduced from a discharge chamber into a crank chamber or refrigerant permitted to escape from said crank chamber to a suction chamber such that a differential pressure developed across said proportional flow rate control solenoid valve is constant, to thereby control refrigerant delivered to said condenser to a constant flow rate.

* * * * *